US010081948B2

(12) United States Patent
Gilsing et al.

(10) Patent No.: US 10,081,948 B2
(45) Date of Patent: Sep. 25, 2018

(54) COMBINATION OF ELEMENTS TO CONSTRUCT A THRESHOLD RAMP CONSTRUCTION, RAMP CONSTRUCTION, AND METHOD TO CONSTRUCT A THRESHOLD RAMP CONSTRUCTION

(71) Applicant: Secuproducts B.V., Nieuw-Vennep (NL)

(72) Inventors: Roy Gilsing, Nieuw-Vennep (NL); Maarten Hendrik Wijninga, Nieuw-Vennep (NL); Christian Jacques Van Bruggen, Nieuw-Vennep (NL)

(73) Assignee: Secuproducts B.V., Nieuw-Vennep (NL)

( * ) Notice: Subject to any disclaimer, the term of this patent is extended or adjusted under 35 U.S.C. 154(b) by 0 days.

(21) Appl. No.: 15/513,567

(22) PCT Filed: Sep. 23, 2015

(86) PCT No.: PCT/NL2015/050663
§ 371 (c)(1),
(2) Date: Mar. 23, 2017

(87) PCT Pub. No.: WO2016/048149
PCT Pub. Date: Mar. 31, 2016

(65) Prior Publication Data

US 2017/0292273 A1 Oct. 12, 2017

(30) Foreign Application Priority Data

Sep. 24, 2014 (NL) ..... 2013519

(51) Int. Cl.
*E04F 11/00* (2006.01)
*E06B 1/70* (2006.01)

(52) U.S. Cl.
CPC ..... *E04F 11/002* (2013.01); *E06B 1/70* (2013.01)

(58) Field of Classification Search
CPC ..... E04F 11/002; E06B 1/70
(Continued)

(56) References Cited

U.S. PATENT DOCUMENTS 4,165,862 A * 8/1979 Bennett ..... B66F 7/243 254/88
4,427,179 A * 1/1984 Price ..... B66F 7/243 251/88

(Continued)

FOREIGN PATENT DOCUMENTS

| | | |
|---|---|---|
| DE | 4008139 A1 | 9/1990 |
| EP | 2311696 A1 | 4/2011 |
| WO | 01/02667 A1 | 1/2001 |

*Primary Examiner* — Raymond W Addie
(74) *Attorney, Agent, or Firm* — Hoffmann & Baron, LLP

(57) ABSTRACT

A combination of elements to construct a threshold ramp construction includes tile elements each having a horizontal upper surface and ramp elements each having an upper surface including a sloped surface part and a horizontal surface part. The horizontal surface part adjoins the higher side of the sloped surface part. The tile elements and the ramp elements are configured to be arranged in superimposed layers to form the ramp construction, in which the superimposed layers include a lower layer and an upper layer, the upper layer supporting on the lower layer. In the ramp construction, the tile and/or ramp elements of the upper layer are arranged in a staggered position with respect to the tile and/or ramp elements of the lower layer.

20 Claims, 8 Drawing Sheets

(58) Field of Classification Search
USPC ..... 14/69.5; 404/34–36
See application file for complete search history.

(56) References Cited

U.S. PATENT DOCUMENTS 4,918,910 A * 4/1990 Sheehan ..... A01F 15/0816 100/45
5,328,154 A * 7/1994 Blatz ..... B66F 7/243 257/88
6,517,051 B1 * 2/2003 Cavanaugh ..... B66F 7/243 14/69.5
6,718,588 B1 * 4/2004 Frederiksen ..... B65G 69/30 14/69.5
6,752,381 B2 * 6/2004 Colak ..... B60T 3/00 254/88
6,993,801 B2 * 2/2006 Marko ..... A63C 19/10 14/69.5
7,003,836 B2 * 2/2006 Berg ..... B66F 7/243 14/69.5
7,073,777 B2 * 7/2006 Branstetter ..... B66F 7/243 254/1
7,104,524 B1 * 9/2006 Hidding ..... B66F 7/243 14/69.5
D550,922 S * 9/2007 Bain ..... B60T 3/00 D34/32
D551,152 S * 9/2007 Funk ..... B60T 3/00 D12/217
7,271,507 B2 * 9/2007 LePage ..... H03K 17/0828 307/130
7,980,532 B2 * 7/2011 Wickwire ..... B60T 3/00 254/88
8,935,822 B2 * 1/2015 Frederiksen ..... E04F 11/002 14/69.5
2002/0124332 A1 * 9/2002 Janowak ..... A61G 3/061 14/69.5

* cited by examiner

COMBINATION OF ELEMENTS TO CONSTRUCT A THRESHOLD RAMP CONSTRUCTION, RAMP CONSTRUCTION, AND METHOD TO CONSTRUCT A THRESHOLD RAMP CONSTRUCTION

CROSS-REFERENCE TO RELATED APPLICATIONS

This application is the National Stage of International Application No. PCT/NL2015/050663 filed Sep. 23, 2015, which claims the benefit of Netherlands Application No. NL 2013519, filed Sep. 24, 2014, the contents of which is incorporated by reference herein.

FIELD OF THE INVENTION

The present invention relates to a combination of elements to construct a threshold ramp construction, a ramp construction, and a method to construct a threshold ramp construction. The ramp construction of the invention is in particular intended to be used next to a threshold, i.e. abrupt differences in height level, for example door thresholds, in order to enable wheeled objects to cross these abrupt differences in height level. The ramp construction of the invention may typically be used for wheeled objects, such as rollators, wheel chairs, cycles, motor cycles or scoot mobile.

BACKGROUND OF THE INVENTION

WO 01/02667 A1 discloses a threshold ramp construction comprising wedge shaped ramp elements and flat tile elements. The ramp and tile elements comprise a top wall and at the outer contour thereof side walls with vertical slots that are open at the bottom. The vertical slots are configured to receive coupling elements that couple two adjacent tile elements in a single layer. To form this ramp construction, the ramp elements and tile elements are horizontally connected to each other to form construction layers. The construction layers are then arranged on top of each other. The superimposed construction layers are then vertically coupled to each other by the provision of separate snap-lock coupling pieces that are vertically pressed through respective associated holes of a ramp or tile element of an upper layer and a ramp or tile element of a lower layer that supports the upper layer.

A drawback of the ramp construction of WO 01/02667 A1 is that the assembly of the ramp construction involves building up layers by connecting the ramp and tile elements horizontally to each other in a layer, therewith forming multiple construction layers, and subsequently placing the construction layers on top of each other and connecting the constructing layers to each other with the snap lock coupling pieces.

Another drawback of the ramp construction of WO 01/02667 A1 is that disassembly of the elements of the construction takes a considerable effort and may cause damage of the elements.

A further drawback of the known ramp construction is that separate snap lock coupling pieces are used to connect the layers to each other which requires transport and storage of these separate snap lock coupling pieces. Also, during construction these separate snap lock coupling pieces may get lost. Further, the person assembling the ramp construction may omit vertically coupling of the construction layers which may lead to the risk of relative movement between the construction layers during use.

SUMMARY OF THE INVENTION

An aim of the present invention is to provide a combination of elements suitable to easily construct a threshold ramp construction to make passing of wheelchairs or other wheeled devices over e.g. a door threshold more convenient, or at least to provide an alternative combination of elements to construct a threshold ramp construction.

The invention provides a combination of elements to construct a threshold ramp construction, comprising:

tile elements each having a horizontal upper surface, ramp elements each having an upper surface comprising a sloped surface part and a horizontal surface part, wherein the horizontal surface part adjoins the higher side of the sloped surface part, wherein the tile elements and the ramp elements are configured to be arranged in superimposed layers to form the ramp construction, in which the superimposed layers comprise a lower layer and an upper layer, the upper layer supporting on the lower layer, characterized in that at least the tile elements and/or ramp elements of the upper layer are provided at a bottom side with at least two bottom coupling members, and in that at least the horizontal surface part of the ramp elements of the lower layer and/or the upper surface of the tile elements of the lower layer comprise at least one upper coupling member configured to engage with one of the bottom coupling members, wherein, in the ramp construction, the tile and/or ramp elements of the upper layer are arranged in a staggered position with respect to the tile and/or ramp elements of the lower layer, such that a first bottom coupling member of the at least two bottom coupling members of a tile or ramp element in the upper layer couples with the upper coupling member of a first tile or ramp element of the lower layer, and a second bottom coupling member of the at least two bottom coupling members of the same tile or ramp element in the upper layer couples with the upper coupling member of a second tile or ramp element of the lower layer.

The ramp and tile elements of the invention are constructed to be connected to each other in a staggered relationship. The vertical coupling between the lower coupling members and upper coupling members in this staggered relationship provides both a connection between the upper and the lower layer, and, via this other layer, between different elements within the same layer. As a result, the tile and ramp elements can be assembled easily into a threshold ramp construction that can be placed next to a threshold or other abrupt height difference.

A layer may be constructed of multiple tile and/or ramp elements. The tile and/or ramp elements are connected to each other by connections of lower and upper coupling members connecting the ramp and tile elements in the staggered relationship. This provides many vertical connections between the elements of different layers resulting in a very stable ramp construction without the need of separate layer connection elements, such as snap lock coupling pieces, configured to provide a vertical connection between two superimposed layers. The tile and/or ramp elements of a single layer are not directly connected to each other, but only via an other layer.

The upper and lower coupling members of the ramp and tile elements can advantageously be arranged in the form of a matrix, wherein multiple coupling members of multiple ramp elements and/or tile elements are arranged in one or more rows. Within each row, the coupling members may be spaced at a constant distance, i.e. a constant pitch, and the rows may also be spaced at a constant distance, i.e. with a constant pitch. The pitch of matrix within the rows and the pitch between the rows are preferably the same.

The use of such matrix basis makes it possible to connect the elements in various configurations to each other. As a result, a relative small number of elements can be used to construct ramp constructions of various shapes and dimensions, which provides the possibility to adapt the ramp construction to a high extent to the actual location where the ramp construction is desired without the need to have a large number of different types of ramp and tile elements.

The elements of the ramp construction according to the invention may be made of any suitable material, but are preferably made of plastics material.

It is remarked that in this patent application the terms "vertical" and "horizontal" refer to the directions of the ramp construction or elements thereof, when the ramp construction or the elements thereof are arranged on a flat horizontal ground surface in their position of use.

It is further remarked that two ramp constructions can be arranged at opposite sides of a threshold, whereby one or more connecting elements may be provided to connect the ramp constructions at opposite sides of the threshold to each other.

In an embodiment, the coupling between lower coupling members and upper coupling members is manually releasable such that the ramp construction can be disassembled. Since there are no direct horizontal connections between elements within a single layer, the elements can be disassembled easily and quickly by manually releasing the vertical connections between the lower coupling members and upper coupling members without destruction of the elements or parts thereof.

As a result, the tile and ramp elements may be reused and reassembled into a ramp construction of the same or other dimensions without the need to replace all or part of the elements used for the ramp construction.

In an embodiment, the at least two lower coupling members are coupling extensions extending from a bottom side of the respective element, and the at least one upper coupling member is a coupling recess configured to receive and engage with one of the coupling extensions. The use of coupling extensions at the bottom of the elements and coupling recesses at the top side of the element has the advantage that the top layer of the ramp construction may be relatively flat, in particular since the coupling recesses of the top layer may be filled by suitable cap elements that fill the coupling recesses of the top layer.

In an embodiment, a bottom end of the at least one coupling recess is closed by a bottom wall, wherein the bottom wall of the coupling recess preferably comprises a drainage hole having a substantially smaller dimension than the coupling recess.

The bottom wall may provide a support surface to support a coupling extension arranged in the coupling recess. A further advantage of such construction is that the holes or holes in the horizontal surface of the tile elements are substantially closed to prevent that dirt will collect in the ramp construction and/or that objects will fall into the coupling recesses and/or objects, for example stiletto heels, will get stuck in the coupling recesses.

In an embodiment, the at least two coupling extensions have a substantially cylindrical shape, and the at least one coupling recess comprises a cylindrical circumference mating with the cylindrical shape of the coupling extensions. Cylindrical shapes of the coupling extensions and coupling recess provide the possibility to mount the tile elements and ramp elements in different angles with respect to each other and as a result in different configurations with respect to each other. This makes the system of the invention even more versatile. It is however remarked that other shapes, such as square or polygonal shaped recesses may also provide the possibility of mounting the tile elements and ramp elements at multiple angles.

In an embodiment, the at least two coupling extensions have a locking rim to couple with a locking edge of the coupling recess. It is advantageous that the coupling between a coupling extension and a coupling recess have locking means, such as a locking rim and a locking edge, to engage and lock the connection between the coupling extension and the coupling recess. Such locking rim and locking edge provide a fixed coupling, in particular a snap-fit connection, between the ramp and/or tile elements such that the elements will not easily be disconnected, for instance when lifting the ramp construction while holding only some of the elements. Furthermore, the locking rim and locking edge may provide a click fit connection which provides audible and/or haptic feedback on proper placement of the coupling extension in the coupling recess.

Further, the connection between locking rim and locking edge can be configured to provide a proper coupling strength between two elements such that the elements will not easily release from each other, but that with some additional force the elements are manually releasable and may be disassembled without the risk of damaging the elements.

In an embodiment, the tile elements and ramp elements each comprise: a top wall forming the upper surface including the at least one coupling recess, side walls extending vertically downwards from an outer contour of the top wall, and two or more tubular walls extending downwardly from the top wall, wherein the two or more tubular walls extend vertically downwards below the side walls and form the two or more coupling extensions. Such build-up of the tile and ramp elements with an upper wall, side walls and tubular walls can easily be manufactured, in particular by injection moulding and provides strong construction elements with a relative low amount of material required.

A longitudinal vertical axis of the tubular wall of one of the two or more coupling extensions is preferably aligned with the longitudinal vertical axis of the at least one coupling recess.

In an embodiment, the sloped surface part comprises a first slope part sloping in a first sloping direction and a second slope part sloping in a second sloping direction, wherein the first and second sloping direction are perpendicular. Such sloped surface part having a sloped surface in two perpendicular sloping directions may be used at a corner of the ramp construction to create sloped surfaces in two directions. Such multi sloped surface may provide the advantage that a wheeled vehicle may be driven on the ramp construction from various angles. The transition from the first slope part to the second slope part may be formed at a single line or by a transition area in which the slope direction for example gradually changes from the first slope direction to the second slope direction.

In an embodiment, the combination of elements further comprises one or more wedge elements having a sloped top surface and two or more lower coupling members to couple with the upper coupling members of a lower layer, wherein preferably a wedge element height of the highest side of the one or more wedge elements is lower than an element height of the ramp and tile elements. Such wedge element may be used to bridge a height difference between a threshold and a top layer of ramp elements and tile elements, when this height difference is smaller than the height of the tile elements and ramp elements.

In an embodiment, at least one of the one or more wedge elements comprises one or more separable wedge element parts, wherein at least one of the separable wedge element parts, when separated, provides a wedge element part having a smaller height than the unseparated complete wedge element height of the wedge element. By providing separable wedge element parts within a wedge element, the height of the wedge element, and therewith the height of the complete ramp construction may further be adapted to the height of a threshold.

In an embodiment, the combination further comprises bottom elements comprising recesses to receive coupling extensions of the ramp and/or tile elements of the lowest layer of ramp and tile elements, wherein a bottom element height of the bottom elements is lower than an element height of the ramp and tile elements. The bottom element height of the bottom elements may be the same as the distance with which the coupling extensions extend below side walls of the respective tile or bottom element. The bottom element height may however also be larger or smaller than this distance.

The bottom element can be used to fill the gap between the bottom edge of the sloped surface of the ramp element and the ground surface when the coupling extensions of the elements of the lowest layer are directly placed on a floor surface.

The bottom elements arranged below the lower edge of the ramp elements may be provided with a sloped surface to provide a smooth transition between the floor surface and the sloped surface of the ramp element. Furthermore, the bottom elements may be arranged in a staggered relationship with respect to the ramp and/or tile elements arranged on the bottom elements to further improve the mutual constructional relationship between the different elements of the ramp construction. The bottom elements may also be used to avoid that dirt or dust collects below the ramp construction.

In an embodiment, a pitch between at least two adjacent coupling extensions is at least the same, preferably at least twice a layer height of a layer of ramp and/or tile elements.

The layer height of the ramp and/or tile elements may be in the range of 10 mm to 40 mm, preferably 15 mm to 30 mm. The pitch of two adjacent couplings members, in particular coupling extensions, may be 30 mm to 120 mm, preferably 40 mm to 80 mm.

In an embodiment, a slope angle of the sloped surface part is in the range of 2 to 20 degrees, preferably in the range of 5 to 15 degrees, for example about 10 degrees. A slope angle in this range, for example a slope angle of about 10 degrees is small enough to enable a wheeled vehicle easy access to the top side of the ramp construction without the need of providing a wide ramp construction.

In an embodiment, the combination comprises one or more functional devices comprising at the bottom side at least one coupling extension configured to be coupled in a coupling recess of the tile element and/or the ramp element.

These functional devices can be used to integrate several functions in the ramp construction and/or can be used to improve the physical appearance of the ramp construction. The functional devices may for example comprise brush elements, light elements, friction increasing elements, reflective or fluorescent elements, coloured elements, cover elements, etc.

The invention also relates to a ramp construction constructed with a combination of elements according to any of the embodiments described herein.

The elements of the ramp construction provide a versatile system with which various sizes and heights of ramp constructions can be built.

Further, the invention relates to a method to construct a ramp construction, comprising the steps of:

providing a combination of elements according to any of the embodiments described herein;

arranging a first layer of ramp and tile elements on a support surface; and placing ramp and tile elements in a staggered relationship on the first layer to form a second layer, comprising connecting coupling extensions of the ramp and tile elements of the upper layer with respective coupling recesses of ramp and tile elements of the first layer to link the ramp and tile elements of the first layer and second layer.

The method may further comprise one or more of the following steps:

selecting a number of tile elements and ramp elements to assemble a ramp construction with desired shape and dimensions;

arranging one or more bottom elements below the lower layer of ramp and tile elements;

placing a wedge element on a top layer of ramp and tile elements, wherein the height of the wedge element is based on the difference in height between the top layer and the height of the abrupt height difference next to which the ramp construction is placed; and/or adapting a height of the wedge element by separating one or more separable parts of the wedge element, before placing the wedge element on the top layer of ramp and tile elements.

BRIEF DESCRIPTION OF THE DRAWINGS

Further examples and advantages of the invention will be elucidated at the hand of an exemplary embodiment of a combination of elements, whereby reference will be made to the accompanying drawings in which.

DETAILED DESCRIPTION OF THE INVENTION

Figure 9:
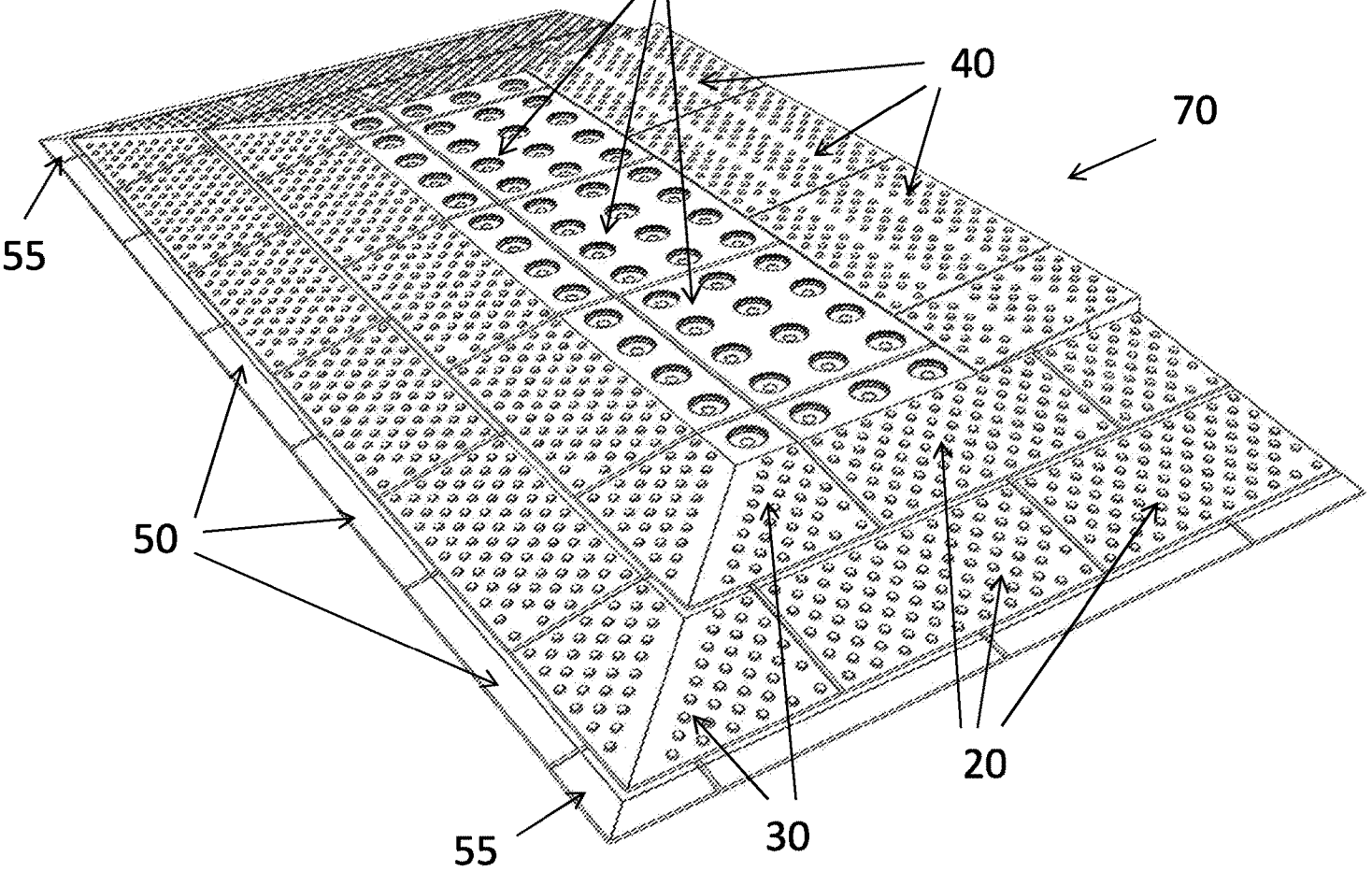
FIG. 9 shows an embodiment of a ramp construction according to the invention.

The invention relates to a combination of elements that can be assembled to form a ramp construction, as for instance shown in FIG. 9. The ramp construction may typically be used next to abrupt differences in height level, such as thresholds, in order to enable wheeled objects to cross these abrupt differences. Such wheeled objects are for example rollators or wheel chairs. The ramp construction of the invention may however also be used for other wheeled objects such as for example cycles, motor cycles or scoot mobiles.

The combination of elements of the ramp construction may comprise tile elements, ramp elements, corner ramp elements, wedge elements and bottom elements. These elements will first be discussed separately.

Figure 1:
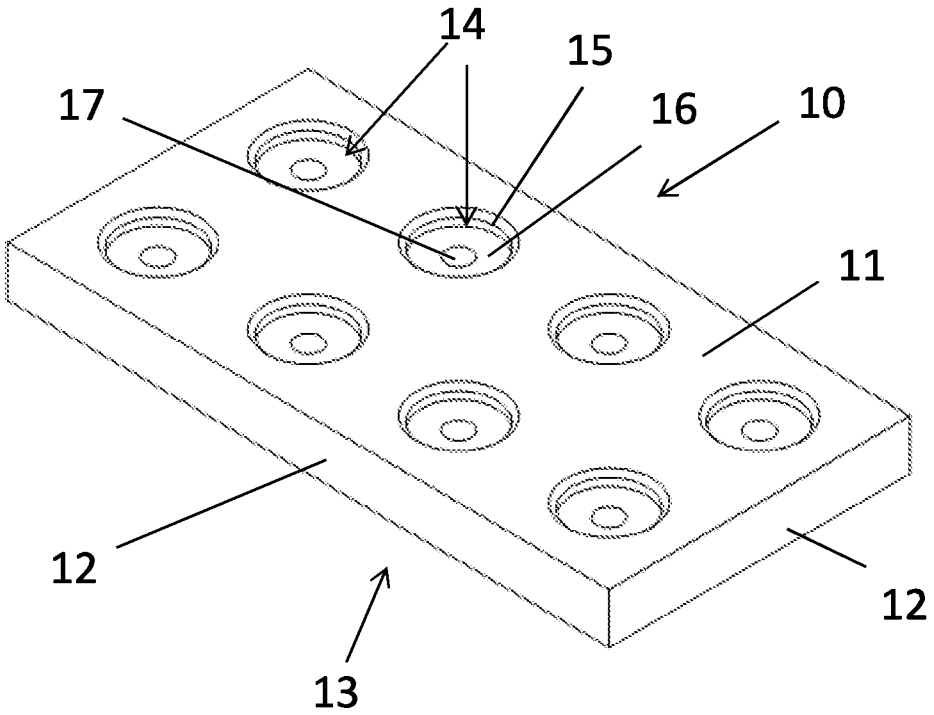
FIG. 1 shows a perspective top view of an embodiment of a tile element.
Figure 2:
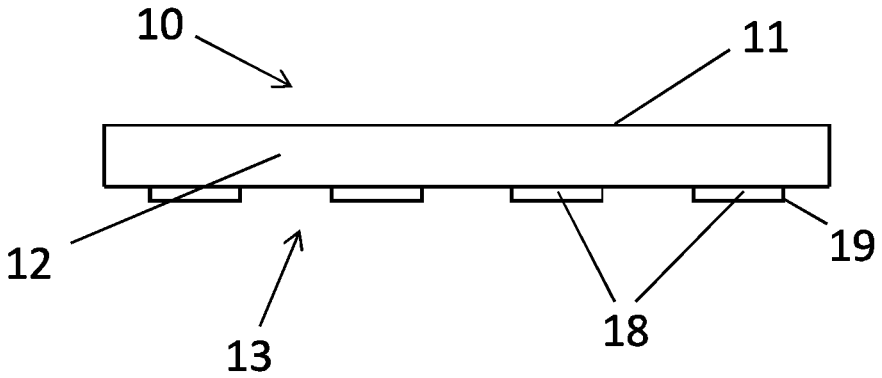
FIG. 2 shows a side view of the tile element of FIG. 1.

FIGS. 1 and 2 show a tile element generally indicated by reference numeral 10. The tile element 10 comprises a rectangular horizontal upper surface 11, side walls 12 and a bottom side 13.

In the upper surface 11 eight coupling recesses 14 are provided in a matrix of 2 x 4. The coupling recesses 14 each have a cylindrical circumference and are provided with a circumferential locking edge 15. At the lower side of each the coupling recesses 14 an annular recess bottom wall 16 is provided that delimits the coupling recess 14. The recess bottom wall 16 is provided with a drainage opening 17.

At the bottom side 13 of the tile element 10 eight coupling extensions 18 extend downwardly below the side walls 12. The coupling extensions 18 are also arranged in a matrix of 2×4 and are each aligned with a coupling recess 14, i.e. longitudinal vertical axes of the coupling extensions 18 coincide with respective longitudinal vertical axes of the coupling recesses 14. The coupling extensions 18 are tubular and provided with a locking rim 19 to cooperate in the form of a snap-fit locking connection with the locking edge 15 of another underlying element as will be described hereinafter.

The pitch between the longitudinal axes of the coupling recesses 14 and coupling extensions 18 is the same, and may for example be in the range of 40 to 100 mm, preferably about 60 mm in both horizontal directions.

The element height, i.e. the height of the tile elements may for example be in the range of 10 mm to 40 mm, preferably about 25 mm. The size of the tile element 10 may for example be 120 mm×240 mm×25 mm, in which the coupling extensions extend 5 mm below the side walls so that the layer height of an actual layer of these elements will be 20 mm.

Any other suitable dimensions may however also be used.

Figure 3:
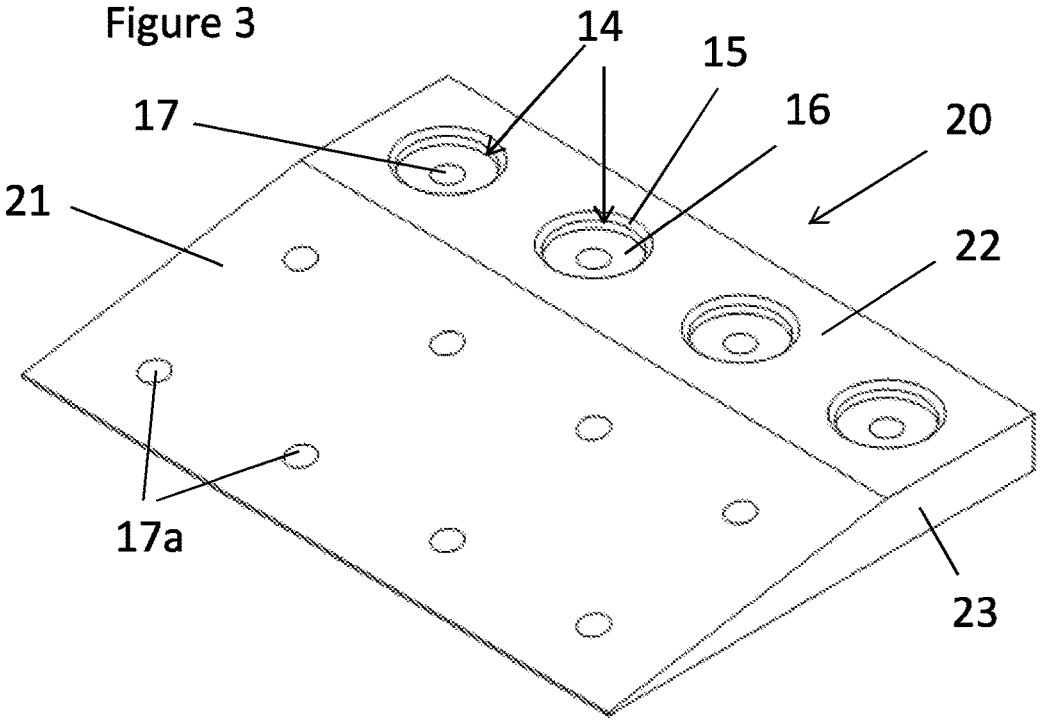
FIG. 3 shows a perspective top view of an embodiment of a ramp element.
Figure 4:
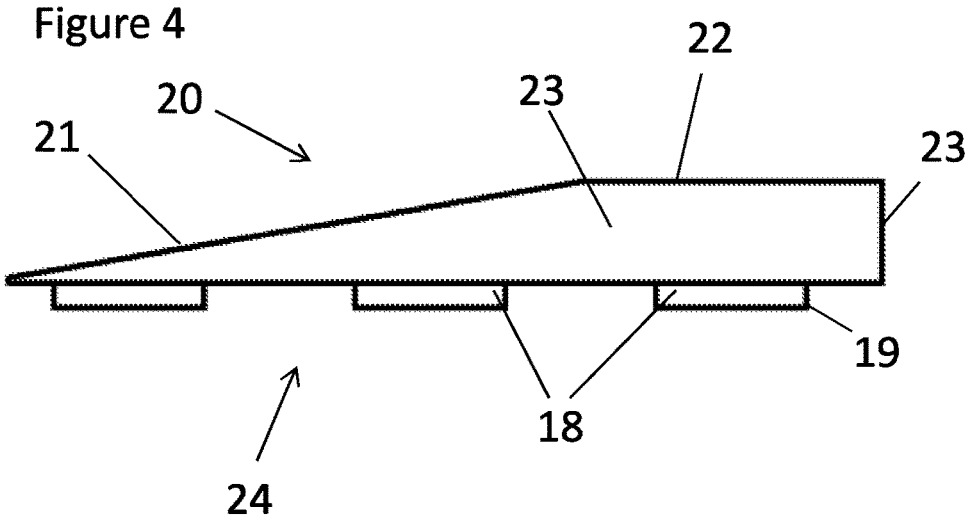
FIG. 4 shows a side view of the ramp element of FIG. 3.

FIGS. 3 and 4 show a ramp element 20. The ramp element 20 comprises an upper surface having a sloped surface part 21 and a horizontal surface part 22. The sloped surface part 21 slopes from a first side of the ramp element 20 having a low height over two thirds of the ramp element 20 to a height that corresponds with the height of the horizontal surface part 22 so that the sloped surface part directly adjoins the horizontal surface part 22.

The horizontal surface part 22 is thus arranged at the higher side of the sloped surface part 21 and runs over the other third to the side opposite the first side of the ramp element 20. The height of the horizontal surface part 22 is the same as the height of the horizontal upper surface 11 of the tile element 10.

The ramp element 20 further comprises side walls 23 and a bottom side 24.

The side walls 12 of the tile element 10 and the side walls 23 of the ramp element 20 are formed by closed walls, i.e. no openings or holes are provided in the side walls 12, 23.

Similarly to the tile element 10, the ramp element 20 comprises coupling recesses 14 and coupling extensions 18.

The horizontal surface part 22 of the ramp element 20 comprises four coupling recesses 14 provided in a matrix of 1×4. The coupling recesses 14 are shaped the same as the coupling recesses of the tile element 14 with a cylindrical circumference, a locking edge 15, and a recess bottom wall 16. The recess bottom wall 16 is provided with a drainage opening 17. The sloped surface part 21 does not comprise coupling recesses 14. In the shown embodiment, drainage holes 17*a* are provided in the sloped surface part 21. However, in alternative embodiments, these drainage holes may partially or completely be omitted, and for example be replaced by bumps to increase the grip on the sloped surface part 21.

From the bottom side 24 of the ramp element 20 twelve coupling extensions 18 extend. The coupling extensions 18 are arranged in a matrix of 3×4 and have the same shape and dimensions as the coupling extensions 18 of the tile element 10. The four coupling recesses 14 are each aligned with one of the coupling extensions 18, i.e. longitudinal axes of the coupling extensions 18 coincide with respective longitudinal axes of the coupling recesses 14.

The pitch between the longitudinal axes of the coupling recesses 14 and/or the coupling extensions 18 is the same. The size of the shown embodiment of the ramp element 20 may for example be 174 mm×240 mm×20 mm.

The slope angle of the sloped surface part may for example be in the range of 5 to 15 degrees, for example about 10 degrees.

The coupling extensions 18 and coupling recesses 14 are configured to be coupled with each other when one tile element 10 or ramp element 20 is arranged (partly) on top of another tile element 10 or ramp element 11. In this way a ramp construction is built up in layers, in which individual ramp or tile elements in one layer are connected to each other via vertical coupling connections, using the coupling recesses and coupling extensions, with other layers.

In practice, also other tile elements 10 and ramp elements 20 will be provided to construct a ramp construction. These tile elements 10 and ramp elements 20 may have the same dimensions as but also other dimensions than the tile element 10 and the ramp element 20.

As a basis for all ramp and tile elements a matrix set up is used, wherein a pitch between the vertical longitudinal axes of coupling extensions 18 and/or coupling recesses 14 of the ramp and tile elements is the same for all elements, or a multiple thereof. This provides a very flexible setup to create different ramp constructions having different sizes and shapes using a limited number of types of elements.

To form a ramp construction, matrix size dimensions of 4×4, 2×4, 2×2 in tile elements and 3×4, 3×2 and 3×3 in ramp elements may be used. However, other matrix dimensions may also be used in the assembly of ramp constructions.

Figure 5:
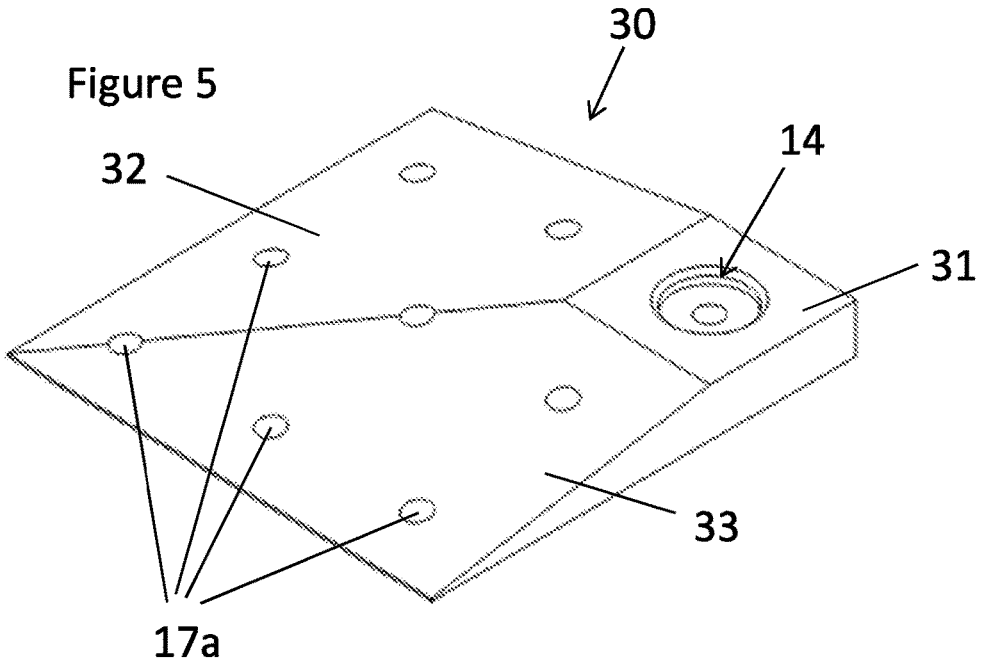
FIG. 5 shows a perspective top view of another embodiment of a corner ramp element.

FIG. 5 shows an embodiment of a corner ramp element 30. Corner ramp element 30 comprises a horizontal surface part 31 and a sloped surface part comprising a first slope part 32 sloping in a first horizontal direction and a second slope part 33 sloping in a second horizontal direction, wherein the first and second horizontal direction are perpendicular. Such corner ramp element 30 can be used at a corner of the ramp construction.

The first slope part 32 and the second slope part 33 are both provided with drainage holes 17a.

The corner ramp element 30 comprises only one coupling recess 14, and has nine coupling extensions 18 at the bottom side of the ramp element (not shown).

Figure 6:
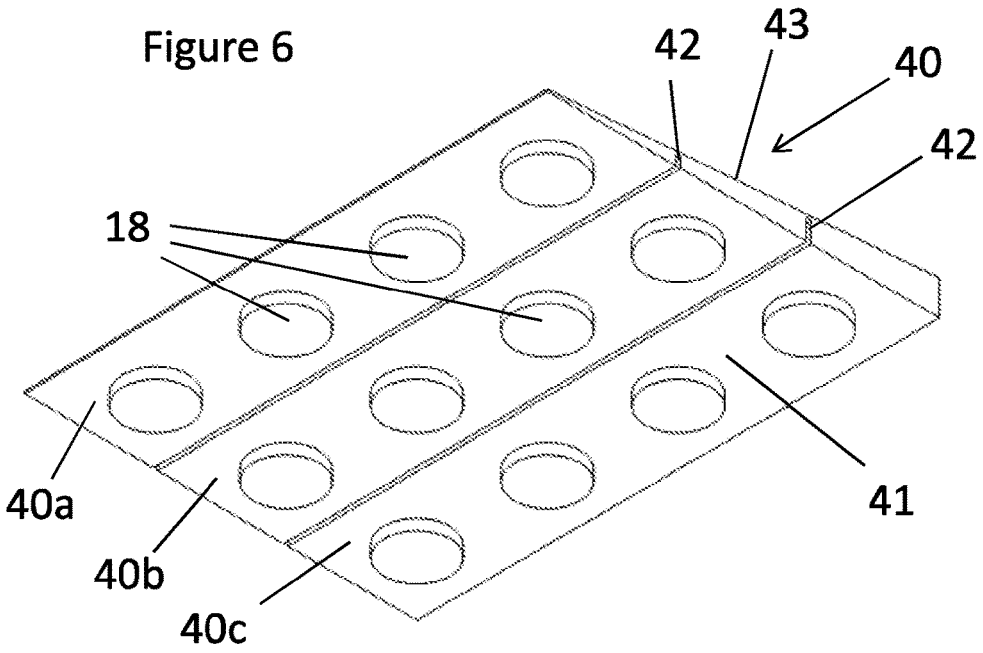
FIG. 6 shows a perspective bottom view of a wedge element.

FIG. 6 shows a wedge element 40 that can be arranged at the top of the ramp construction. The wedge element 40 is a solid body of material, for example plastic material.

The wedge element 40 has a horizontal bottom surface 41 comprising coupling extensions 18 to be coupled with coupling recesses 14 of a lower layer. The coupling extensions 18 are arranged in a matrix of 3×4 with a corresponding pitch as in the tile element 10 and the ramp element 20. The wedge element 40 further comprises a sloped upper surface 43.

The maximum height of the wedge element 40 is smaller than the element height of the tile element 10 and the ramp element 20, so that the wedge element 40 can be used to obtain a smooth transition when there is a height difference between the door threshold next to which the ramp construction is placed and the height of the ramp construction, when this height difference is smaller than the layer height of tile and ramp elements. The maximum height of the wedge element 40 is for example approximately three quarters of the layer height.

In an example embodiment, the wedge element has, excluding the coupling extensions 18 a maximum height of 16 mm and a width of 180 mm resulting in a wedge element slope angle of about 5 degrees. In practice, this wedge element slope angle may be in the same range as the slope angle of the sloped surface of the ramp elements 20 and corner ramp elements 30, although due to the function of the wedge element, it is likely that the wedge element slope angle will be smaller than the slope angle of the sloped surfaces 21, 32, 33 of the ramp elements 20 and corner ramp elements 30.

The wedge element is provided with parallel cutting slits 42 that allow to divide the wedge element 40 in three parts 40*a*, 40*b*, and 40*c*. By cutting at one of the cutting slits 42, part 40*a* can be separated from parts 40*b* and 40*c* or parts 40*a* and 40*b* can be separated from part 40*c*, respectively. Therewith, the maximum height of the resulting wedge element, i.e. the separated part 40*a* or combination of parts 40*a* and 40*b*, is reduced to the height of the respective separated part 40*a* or combination of parts 40*a* and 40*b*. In this way the total height of the ramp construction can be further adapted to the actual height of the threshold next to which it is placed. Since the wedge element 40 has two cutting slits 42 the maximum height of the wedge element 40 used as top layer in the ramp construction may be about 5.3 mm (only part 40*a*), about 10.6 mm (parts 40*a* and 40*b*) and 16 mm (parts 40*a*, 40*b*, and 40*c*).

Figure 7:
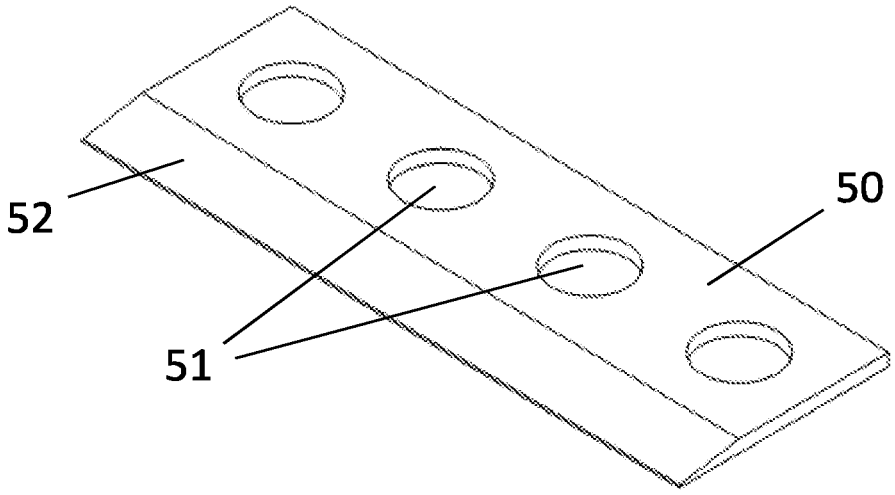
FIGS. 7 and 8 show embodiments of bottom elements.
Figure 8:
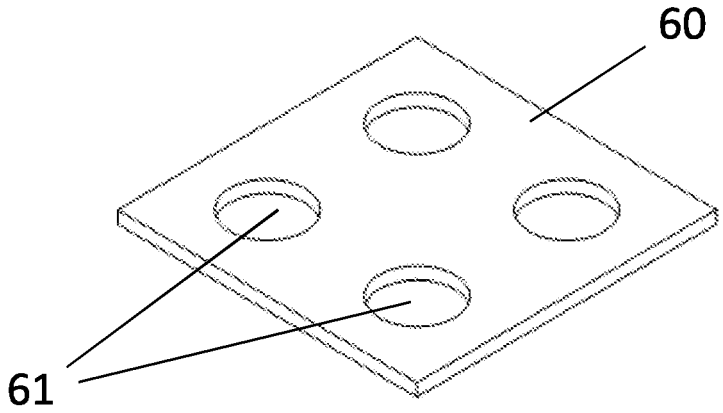

FIGS. 7 and 8 show a first bottom element 50 and a second bottom element 60 that can be placed below the lowest layer of tile elements 10, ramp elements 20 and/or corner ramp elements 30 as the lowest layer of elements of the ramp construction. The first bottom element 50 and the second bottom element 60 are configured to receive the coupling extensions 18 of a bottom layer of tile elements 10 and ramp elements 20, 30, to connect the tile elements 10 and ramp elements 20 and corner ramp elements 30 with respect to each other via the first and second bottom elements 50, 60.

The bottom elements 50, 60 have a flat horizontal surface and are formed by a solid body of material, for example plastics material.

In the first bottom element 50 and the second bottom element 60 openings 51, 61 are provided to receive the coupling extensions 18 of the bottom layer. The openings 51, 61 may have the same shape and dimensions as the coupling recesses 14, so that a snap-fit connection can be provided between the bottom elements 50, 60 and a tile element or ramp element of a layer on top of the bottom elements 50, 60. However, the openings 51, 61 may also have a slightly larger dimension such that a coupling extension 18 can freely move in and out of the openings 50, 60, i.e. without establishing a snap-fit connection. There may also be provided a friction-fit between the coupling extensions 18 and the openings 51, 61.

The first bottom element 50 comprises a sloped surface 52 and is suitable to be used under the lower side of ramp element 20 and corner ramp elements 30 to obtain a smooth transition from a floor surface to the ramp elements of the ramp construction. The second bottom element 60 is suitable to receive coupling extensions of two or four adjacent tile elements 10 and/or higher sides of ramp elements 20 and corner ramp elements 30.

The height of the first bottom element 50 and of the second bottom element 60 corresponds with the length of the coupling extension 18 that extends from the bottom side of the tile/ramp element, i.e. below the lower edge of the side wall. In an embodiment as described above this may be approximately 5 mm.

In an alternative embodiment, the bottom elements 50, 60 may be omitted and the lowest layer of ramp elements and tile elements may support directly with the coupling extensions 18 on the floor surface. However, this may lead to accumulation of dust and dirt under the ramp construction.

Figure 10:
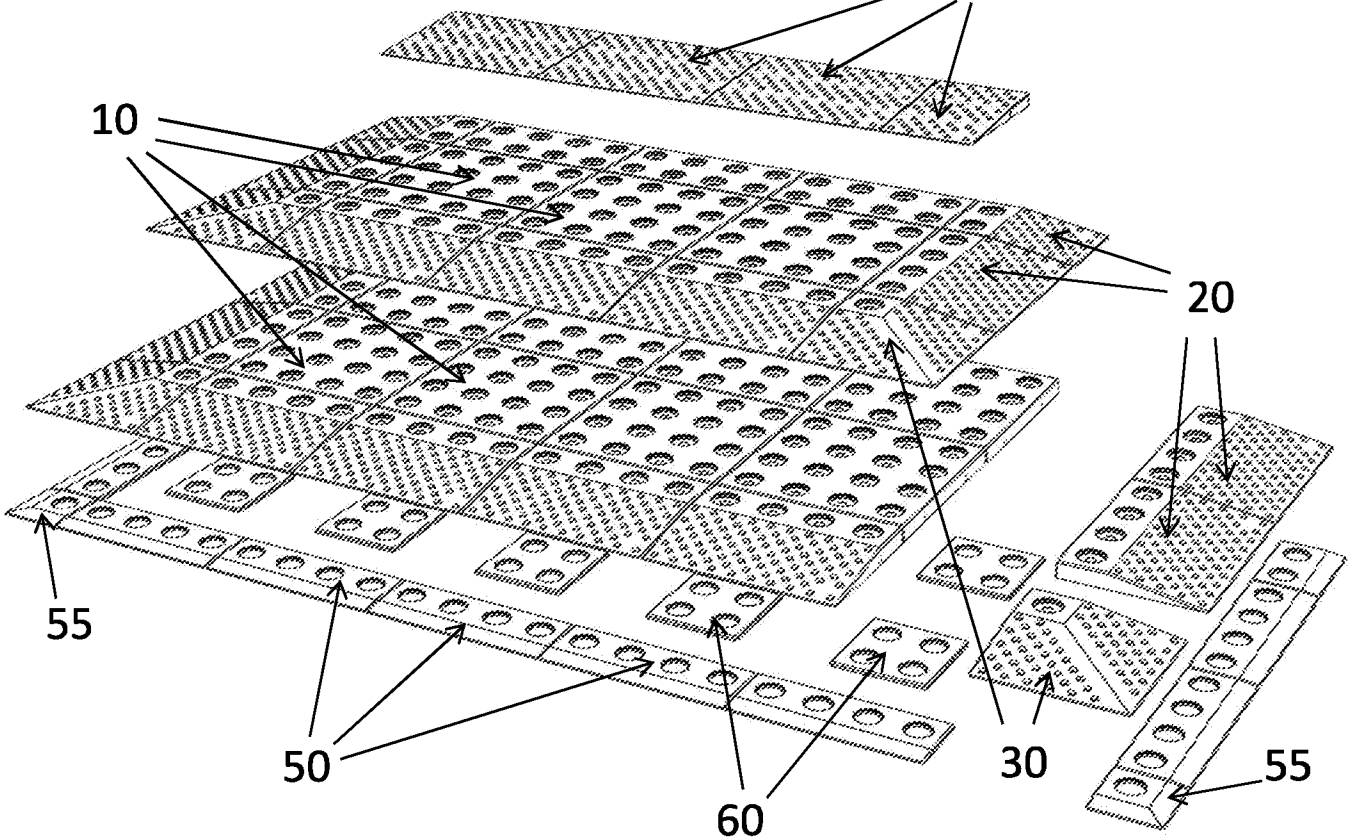
FIG. 10 shows an exploded view of the ramp construction of FIG. 9.

FIG. 9 shows a ramp construction 70 constructed of tile elements 10, ramp elements 20, corner ramp elements 30, wedge elements 40 and bottom elements 50, 55, 60 (see FIG. 10). It is remarked that in the ramp construction 70 shown in FIG. 9, the sloped surface parts 21 of the ramp elements 20 and corner ramp elements 30 do not comprise the drainage holes 17*a* as shown in FIGS. 3 and 5, but are provided with bumps in order to improve the grip on these sloped surface parts.

Further, it is remarked that the layer with bottom elements 50, 60 comprises double sloped bottom elements 55 arranged at the sloped corners of the ramp construction 70.

FIG. 10 shows an exploded view of the elements of the ramp construction 70 shown in FIG. 9. It can be seen that elements of different dimensions are used, but that all elements are based on the same pitch between coupling extensions 18 and/or coupling recesses 14. It is further remarked that within the same layer the tile elements 10 and the ramp elements 20 and corner ramp elements 30 are not directly coupled to each other by horizontal connections.

Figure 11:
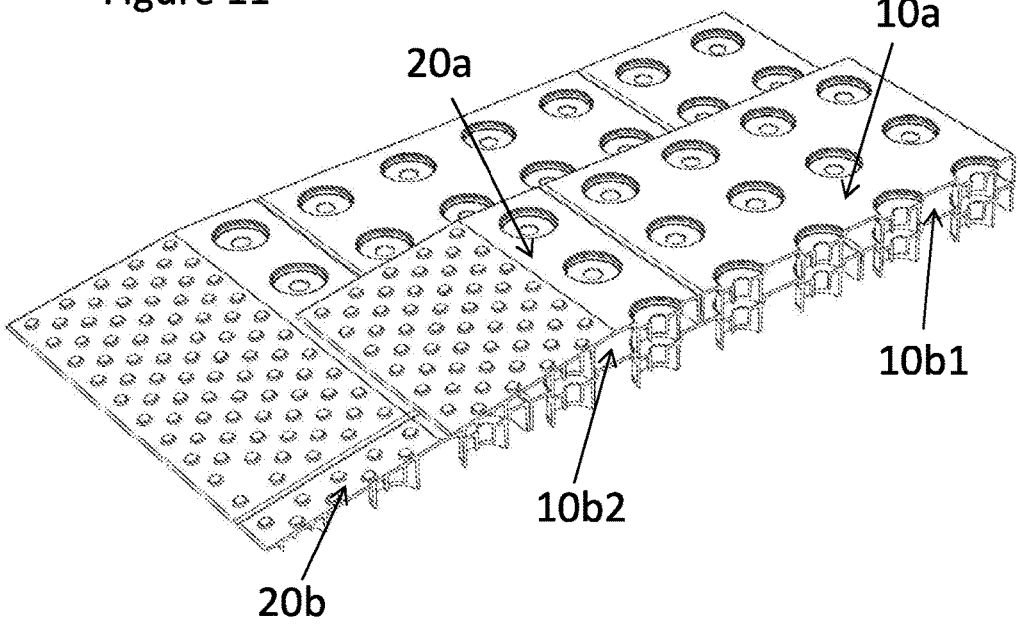
FIG. 11 shows a cross section of tile elements and ramp elements that are connected to each other.
Figure 12:
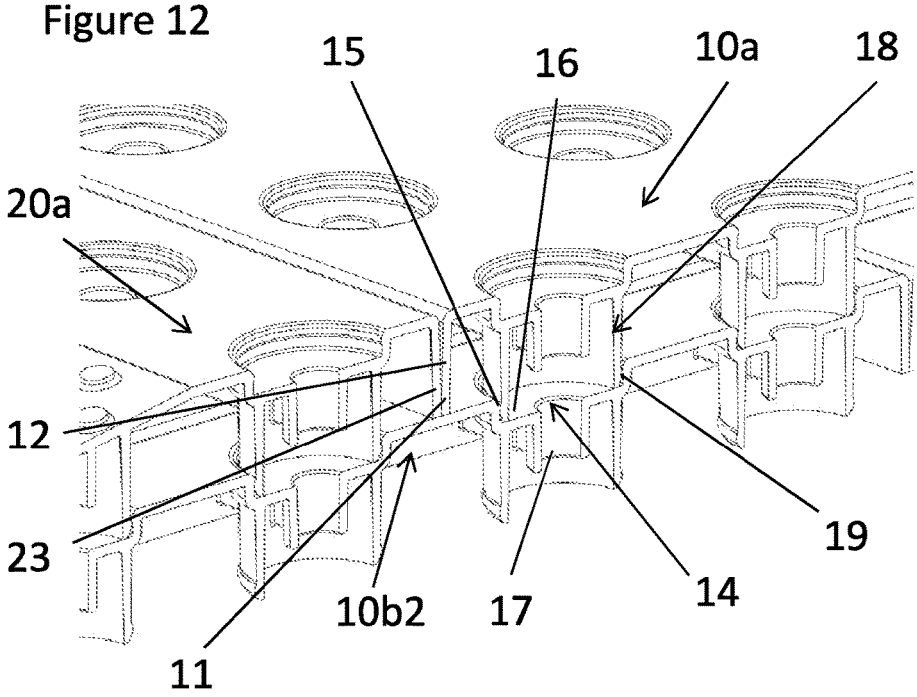
FIG. 12 shows a detail of FIG. 11.

FIGS. 11 and 12 show the vertical coupling between different tile elements 10, ramp elements 20 and corner ramp elements 30 in more detail.

FIGS. 11 and 12 illustrate the build-up of the tile elements and ramp elements. The tile elements 10 and ramp elements 20 each comprise a top wall forming the upper surface including the coupling recesses 14, side walls 12, 23 extending vertically downwards from an outer contour of the horizontal top wall, and two or more tubular walls extending downwardly from the horizontal top wall. The two or more tubular walls extend downwardly below the side walls 12, 13 and form the two or more coupling extensions 18. Some of the tubular walls forming the coupling extensions 18 extend from the recess bottom walls 16 such that a longitudinal vertical axis of the tubular wall of such coupling extension 18 is aligned with the longitudinal vertical axis of the at least one coupling recess 14.

In the cross section of FIG. 11, there is shown a portion of an upper layer comprising a tile element 10*a* and a ramp element 20*a*, and of a lower layer comprising a first tile element 10*b*1, a second tile element 10*b*2 and a ramp element 20*b*. It can be seen that these tile elements 10*a*, 10*b*1, 10*b*2 and ramp elements 20*a*, 20*b* are arranged in a staggered relationship.

There is no direct horizontal coupling between the tile element 10*a* and the ramp element 20*a* of the upper layer and no direct horizontal coupling between the tile elements 10*b*1, 10*b*2 and 20*b* of the lower layer. In the cross-section shown in FIG. 11, two coupling extensions 18 of the tile element 10*a* vertically couple with coupling recesses 14 of the first tile element 10*b*1 and two coupling extensions 18 of the tile element 10*a* vertically couple with coupling recesses 14 of the second tile element 10*b*1. Similarly, in the cross-section shown in FIG. 11, two coupling extensions 18 of the ramp element 20*a* couple with coupling recesses 14 of the second tile element 10*b*2 and one coupling extension 18 of the ramp element 20*a* couples with a coupling recess 14 of the ramp element 20*b*.

In this way, a simple and reliable connection between the different elements is obtained without the need of both horizontal connections and vertical connections. Furthermore, no separate connectors are required to make a connection between the different elements possible.

The coupling between the coupling extensions 18 and the coupling recesses 14 is shown in more detail in FIG. 12. The coupling extension 18 extends, in a coupled position, into the coupling recess 14 so that the locking rim 19 extends past the locking edge 15 of the coupling recess 14 to form a snap-fit connection. As a result, the coupling extension is held by the coupling recess 14 and some force is required to release the coupling extension 18 from the coupling recess 14. The coupling between the coupling extension 18 and the coupling recess 14 may be configured to provide a holding force that can be manually exceeded without a substantial risk on damage to the elements. This makes manual release of the elements possible and therewith disassembly of the ramp construction easy.

In an alternative embodiment, the locking edge 15 and locking rim 19 are not provided, and the coupling extension 18 is held in the coupling recess 14 by a friction-fit connection.

The side wall 12 of the tile element 10*a* and the side wall 23 of the ramp element 20*a* support on the upper surface of the second tile element 10*b*2. Also, the bottom ends of the coupling extensions 18 support on the recess bottom walls 16. This improves strength and stability of the ramp construction.

Figure 13:
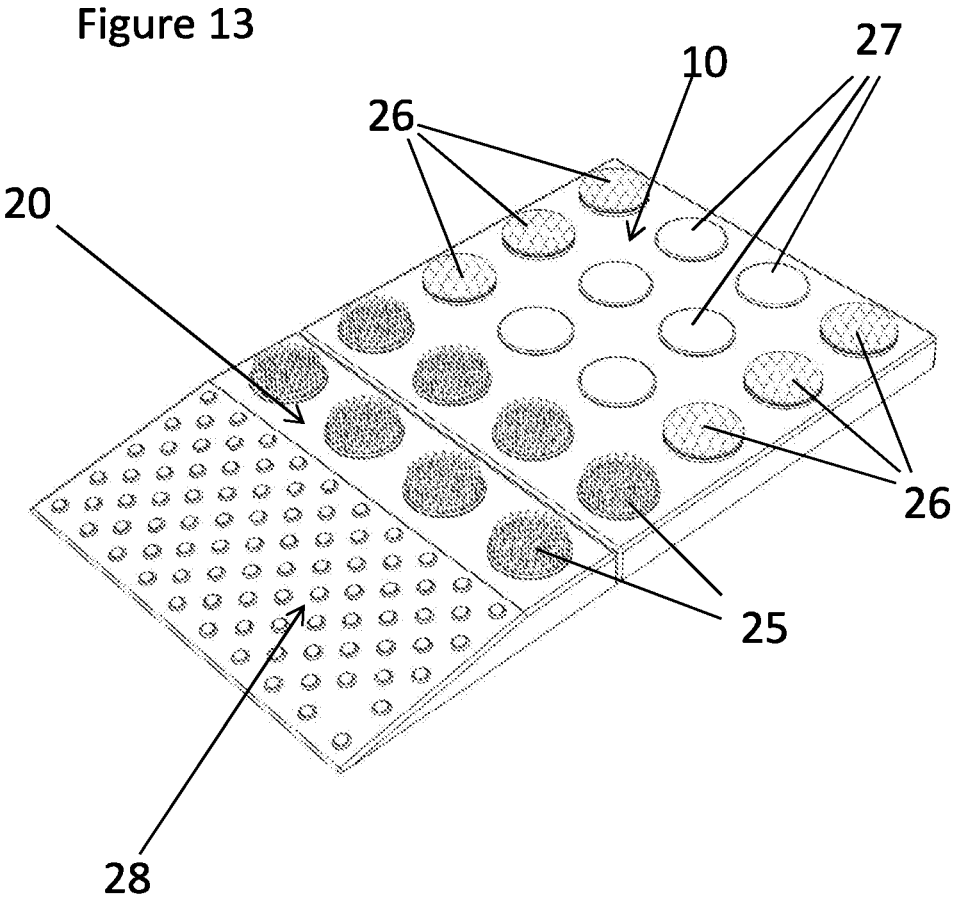
FIG. 13 shows a perspective view on a ramp element and a tile element on which functional devices are provided.

FIG. 13 shows tile element 10 and ramp element 20 arranged next to each other. In the coupling recesses 14 of the tile element 10 and the ramp element 20 different functional devices can be arranged. Preferably, each of the functional devices comprises at a bottom side at least one coupling extension, similar to at least a bottom portion of the coupling extension 18, configured to be coupled in a coupling recess 14 of the tile element 10 or the ramp element 20.

These functional devices can be used to integrate several functions in the ramp construction and/or can be used to improve the physical appearance of the ramp construction. The functional devices may for example comprise brush elements, light elements, friction increasing elements, reflective or fluorescent elements, coloured elements, cover elements, etc.

A number of examples of these functional devices are shown in FIG. 13, and will be described in more detail.

Directly next to the sloped surface part 21, brush elements 25 are provided to form a brush surface to clean bottom surfaces of shoes. The brush elements 25 are circular and have upwardly extending bristles suitable to clean shoes. Each brush element 25 comprises a single coupling extension (not shown) coupled in one of the coupling recesses and a circular base on which the bristles are arranged. The circular base also functions as a cover element to cover the coupling recess 14 to avoid that dirt enters the coupling recess 14.

In an alternative embodiment a brush element may comprise multiple coupling extensions to be coupled to multiple coupling recesses 14.

Further, in the coupling recesses 14 of the tile element 10 two rows of three light devices 26 are mounted that for example can be used as a warning or indicator signal. Each of the light devices 26 comprises a coupling extension coupled in the respective coupling recess 14 of the tile element. Each light element 26 comprises a light source, for example a LED, and a battery to energize the light source. The light source may have one colour or multiple colours and may be arranged to emit continuously or intermittently light.

Further, six cap elements 27 are provided. These cap elements 27 can be used to cover the open coupling recesses 18 of the upper layer to avoid that dust or dirt accumulates in the coupling recess 18. The cap elements may be given a different colour than the colour of the tile element, and may be made of fluorescent or 'glow in the dark' material.

The sloped surface part 21 of the ramp element is not provided with drainage holes, but with bumps 28 to increase the grip on the sloped surface part 21. Also other grip or friction increasing elements may be used for this goal. The bumps may be of the same material or other material. In yet another embodiment, the drainage holes 17*a* of the embodiments of FIGS. 3 and 5 may be used to fix bumps or other elements on the sloped surface part 21.

It is remarked that, in an alternative embodiment, a single device covering multiple coupling recesses may be provided to be mounted on the tile element 10 and/or ramp element 20.

Further, it is remarked that drainage holes 17 of the recess bottom wall 16 of the coupling recesses 14 may be used to push a functional device out of the coupling recess 14.

The invention claimed is:

1. A combination of elements to construct a threshold ramp construction, comprising:

tile elements each having a horizontal upper surface, and ramp elements each having an upper surface comprising a sloped surface part and a horizontal surface part, wherein the horizontal surface part adjoins the higher side of the sloped surface part, wherein the tile elements and the ramp elements are configured to be arranged in superimposed layers to form the ramp construction, in which the superimposed layers comprise a lower layer and an upper layer, the upper layer supporting on the lower layer, wherein at least the tile elements and/or ramp elements of the upper layer are provided at a bottom side with at least two bottom coupling members, wherein at least the horizontal surface part of the ramp elements of the lower layer and/or the upper surface of the tile elements of the lower layer comprise at least one upper coupling member configured to engage with one of the bottom coupling members, wherein, in the ramp construction, the tile and/or ramp elements of the upper layer are arranged in a staggered position with respect to the tile and/or ramp elements of the lower layer, such that a first bottom coupling member of the at least two bottom coupling members of a tile or ramp element in the upper layer couples with the upper coupling member of a first tile or ramp element of the lower layer, and a second bottom coupling member of the at least two bottom coupling members of the same tile or ramp element in the upper layer couples with the upper coupling member of a second tile or ramp element of the lower layer, wherein the at least two lower coupling members are coupling extensions extending from a bottom side of the respective element, wherein the at least one upper coupling member is a coupling recess configured to receive and engage with one of the coupling extensions, and wherein the at least two coupling extensions have a locking rim to couple with a locking edge of the coupling recess.

2. The combination of claim 1, wherein a coupling between the lower coupling member and the upper coupling member is manually releasable.

3. The combination of claim 1, wherein a bottom end of the at least one coupling recess is closed by a bottom wall, wherein the bottom wall of the coupling recess comprises a drainage hole having a smaller dimension than the coupling recess.

4. The combination of claim 1, wherein the at least two coupling extensions have a substantially cylindrical shape, and wherein the at least one coupling recess comprises a cylindrical circumference mating with the cylindrical shape of the coupling extensions.

5. The combination of claim 1, wherein the tile elements and ramp elements each comprise:

a top wall forming the upper surface including the at least one coupling recess, side walls extending vertically downwards from an outer contour of the top wall, and two or more tubular walls extending downwardly from the top wall, wherein the two or more tubular walls extend downwardly below the side walls and form the two or more coupling extensions.

6. The combination of claim 1, wherein the side walls are closed walls.

7. The combination of claim 1, wherein the sloped surface part comprises a first slope part sloping in a first sloping direction and a second slope part sloping in a second sloping direction, wherein the first and second sloping directions are perpendicular.

8. The combination of claim 1, wherein all sides of the tile elements and the higher side of a ramp element have a same element height.

9. The combination of claim 8, wherein the combination of elements further comprises one or more wedge elements each having a sloped top surface and two or more lower coupling members to couple with the upper coupling members of a lower layer, wherein a wedge element height of the highest side of the one or more wedge elements is lower than the element height.

10. The combination of claim 9, wherein at least one of the one or more wedge elements comprises one or more separable parts, wherein at least one of the separable parts, when separated, provides a wedge element having a smaller height than the wedge element height of the wedge element.

11. The combination of claim 8, wherein the combination further comprises bottom elements comprising recesses to receive coupling extensions of the ramp and/or tile elements of the lowest layer of ramp and tile elements, wherein a bottom element height of the bottom elements is lower than the element height.

12. The combination of claim 1, wherein a pitch between at least two adjacent coupling extensions is at least the same.

13. The combination of claim 1, wherein a slope angle of the sloped surface part is in the range of 2 to 20 degrees.

14. The combination of claim 1, wherein the combination further comprises one or more functional devices comprising at a bottom side at least one coupling extension configured to be coupled in a coupling recess of the tile element and/or the ramp element.

15. A ramp construction constructed with a combination of elements according to claim 1.

16. A method to construct a ramp construction, comprising the steps of:

providing a combination of elements according to claim 1;

arranging a first layer of ramp and tile elements on a support surface; and placing ramp and tile elements in a staggered relationship on the first layer to form a second layer, comprising connecting coupling extensions of the ramp and tile elements of the upper layer with respective coupling recesses of ramp and tile elements of the first layer to link the ramp and tile elements of the first layer and second layer.

17. A combination of elements to construct a threshold ramp construction, comprising:

tile elements each having a horizontal upper surface, and ramp elements each having an upper surface comprising a sloped surface part and a horizontal surface part, wherein the horizontal surface part adjoins the higher side of the sloped surface part, wherein the tile elements and the ramp elements are configured to be arranged in superimposed layers to form the ramp construction, in which the superimposed layers comprise a lower layer and an upper layer, the upper layer supporting on the lower layer, wherein at least the tile elements and/or ramp elements of the upper layer are provided at a bottom side with at least two bottom coupling members, wherein at least the horizontal surface part of the ramp elements of the lower layer and/or the upper surface of the tile elements of the lower layer comprise at least one upper coupling member configured to engage with one of the bottom coupling members, wherein, in the ramp construction, the tile and/or ramp elements of the upper layer are arranged in a staggered position with respect to the tile and/or ramp elements of the lower layer, such that a first bottom coupling member of the at least two bottom coupling members of a tile or ramp element in the upper layer couples with the upper coupling member of a first tile or ramp element of the lower layer, and a second bottom coupling member of the at least two bottom coupling members of the same tile or ramp element in the upper layer couples with the upper coupling member of a second tile or ramp element of the lower layer, wherein the at least two lower coupling members are coupling extensions extending from a bottom side of the respective element, wherein the at least one upper coupling member is a coupling recess configured to receive and engage with one of the coupling extensions, and wherein a bottom end of the at least one coupling recess is closed by a bottom wall, wherein the bottom wall of the coupling recess comprises a drainage hole having a smaller dimension than the coupling recess.

18. The combination of claim 17, wherein the at least two coupling extensions have a locking rim to couple with a locking edge of the coupling recess.

19. A combination of elements to construct a threshold ramp construction, comprising:

tile elements each having a horizontal upper surface, and ramp elements each having an upper surface comprising a sloped surface part and a horizontal surface part, wherein the horizontal surface part adjoins the higher side of the sloped surface part, wherein the tile elements and the ramp elements are configured to be arranged in superimposed layers to form the ramp construction, in which the superimposed layers comprise a lower layer and an upper layer, the upper layer supporting on the lower layer, wherein at least the tile elements and/or ramp elements of the upper layer are provided at a bottom side with at least two bottom coupling members, wherein at least the horizontal surface part of the ramp elements of the lower layer and/or the upper surface of the tile elements of the lower layer comprise at least one upper coupling member configured to engage with one of the bottom coupling members, wherein, in the ramp construction, the tile and/or ramp elements of the upper layer are arranged in a staggered position with respect to the tile and/or ramp elements of the lower layer, such that a first bottom coupling member of the at least two bottom coupling members of a tile or ramp element in the upper layer couples with the upper coupling member of a first tile or ramp element of the lower layer, and a second bottom coupling member of the at least two bottom coupling members of the same tile or ramp element in the upper layer couples with the upper coupling member of a second tile or ramp element of the lower layer, wherein all sides of the tile elements and the higher side of a ramp element have a same element height, wherein the combination of elements further comprises one or more wedge elements each having a sloped top surface and two or more lower coupling members to couple with the upper coupling members of a lower layer, and wherein a wedge element height of the highest side of the one or more wedge elements is lower than the element height.

20. The combination of claim 19, wherein the at least two lower coupling members are coupling extensions extending from a bottom side of the respective element, wherein the at least one upper coupling member is a coupling recess configured to receive and engage with one of the coupling extensions, and wherein the at least two coupling extensions have a locking rim to couple with a locking edge of the coupling recess.

* * * * *